United States Patent [19]

Theurer et al.

[11] Patent Number: 5,067,412

[45] Date of Patent: Nov. 26, 1991

[54] TIE PLATE INSERTING MACHINE

[75] Inventors: Josef Theurer, Vienna; Herbert Wörgötter, Linz, both of Austria

[73] Assignee: Franz Plasser Bahnbaumaschinen-Industriegesellschaft m.b.H., Vienna, Austria

[21] Appl. No.: 602,413

[22] Filed: Oct. 22, 1990

[51] Int. Cl.[5] ..... E01B 9/02

[52] U.S. Cl. ..... 104/16

[58] Field of Search ..... 104/2, 4, 5, 16; 198/456

[56] References Cited

U.S. PATENT DOCUMENTS

| | | | |
|---|---|---|---|
| 3,691,639 | 9/1987 | Holley | 104/16 |
| 3,943,858 | 3/1976 | Dieringer et al. | 104/16 |
| 4,241,663 | 12/1980 | Lund et al. | 104/16 |
| 4,280,613 | 7/1981 | Stewart | 104/16 |
| 4,893,565 | 1/1990 | Theurer et al. | 104/2 |
| 4,974,518 | 12/1990 | Cotic et al. | 104/16 |

*Primary Examiner*—Joseph F. Peters, Jr.
*Assistant Examiner*—Virna Lissi Mojica
*Attorney, Agent, or Firm*—Collard, Roe & Galgano

[57] ABSTRACT

A tie plate inserting machine comprises a self-propelled machine frame, an operating unit mounted on the machine frame and comprising a vertically adjustable magazine for storing at least one tie plate, a tie plate inserting arm for moving a respective tie plate stored in the magazine from the magazine to a position between a tie and the base of a rail, the tie plate inserting arm being transversely displaceable with respect to the machine frame and being connected to the operating unit, and a rail lifting device associated with the operating unit.

12 Claims, 2 Drawing Sheets

Fig.3
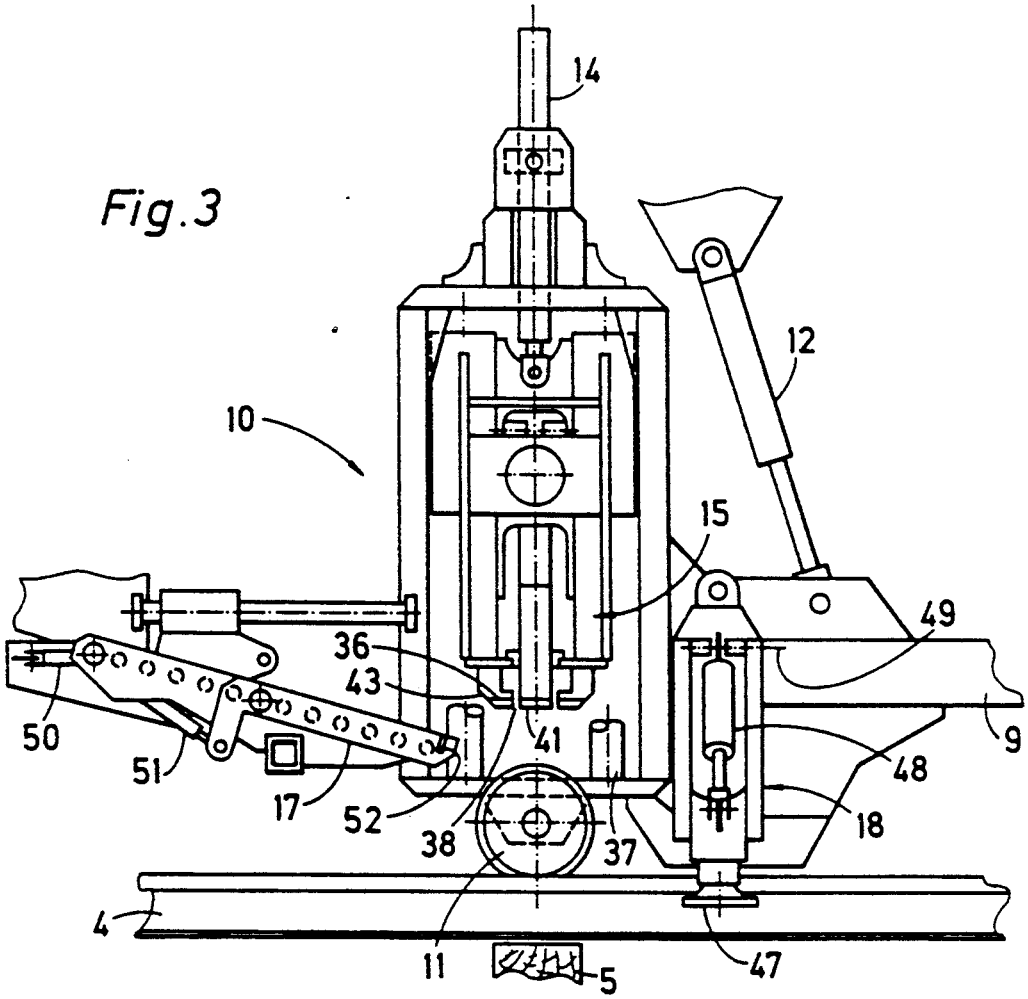
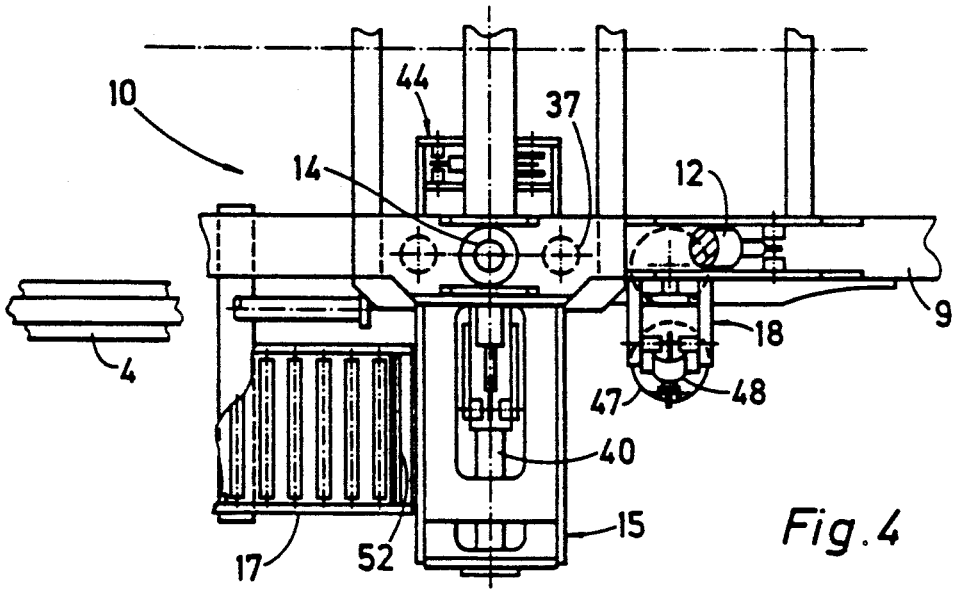
Fig.4

TIE PLATE INSERTING MACHINE

BACKGROUND OF THE INVENTION

1. Field of the Invention

The present invention relates to a tie plate inserting machine.

2. Description of the Prior Art

When a new tie is inserted into a railroad track, a tie plate must be inserted between the tie and the base of each track rail, the tie plate then being fastened to the tie and the tie plate holding the rail on the tie. This insertion of the tie plates has heretofore been effected manually, and to form the required gap between the rail and the tie for insertion of the tie plate, winches were used to lift the rail slightly. Since the winch was supported on the loose ballast bed, accidents frequently occurred, due to the tensile stresses in the lifted rail. In addition, the required manual labor makes the operation very uneconomical.

SUMMARY OF THE INVENTION

It is the primary object of this invention to provide a machine for inserting tie plates for automating this track rehabilitation operation and placing the tie plates in their correct end position with great efficiency.

This and other objects are accomplished according to the invention with a machine for inserting a tie plate between a tie and a rail having a head and a base interconnected by a web, which comprises a machine frame supported on undercarriages on a railroad track including two of said rails resting on a multiplicity of said ties, and a drive for propelling the machine frame along the track in an operating direction. An operating unit is mounted on the machine frame, which comprises a vertically adjustable magazine for storing at least one of the tie plates and a drive for vertically adjusting the magazine. A tie plate inserting arm for moving a respective one of the tie plates stored in the magazine from the magazine to a position between the tie and the base of the rail is transversely displaceable with respect to the machine frame and is connected to the operating unit, and a drive is provided for transversely displacing the tie plate inserting arm. A rail lifting device is associated with the operating unit.

Such a machine for the first time enables tie plates to be fully automatically positioned properly so that the track rehabilation work can proceed at a uniform speed with high efficiency. The vertically adjustable tie plate magazine enables each tie plate to be lowered into the correct vertical position immediately above the tie and the transversely displaceable inserting arm then moves the tie plate rapidly into the gap between the tie and the rail base. This gap is held constant by means of the rail lifting device adjacent the operating unit to assure a trouble-free tie plate insertion.

According to a preferred feature of the present invention, the magazine includes a tie plate support, the tie plate support extending in a transverse plane with respect to the machine frame has a gradient of about 3° to 10°, and the tie plate support has one end facing the rail and another end opposite thereto, the one tie plate end being lower than the other tie plate end. Tie plates have two parallel ribs wherebetween the rail is held on the tie, and the inclined plane of the tie plate support will assure a problem-free gliding of the tie plate rib closer to the rail into the gap between the tie and the rail base because of the lower position of this tie plate rib.

Problem-free transverse displacement of the tie plate into the desired position is assured with a tie plate inserting arm having an end connected to a finger-like extension inclined in a direction towards the center of the machine frame, and a tie plate support defining a slot for receiving the tie plate inserting arm end, the slot extending in a direction parallel to the longitudinal extension of the tie and centrally with respect to the longitudinal extension of the machine frame.

If a respective operating unit is associated with each of the rails, the efficiency of the machine will be substantially doubled since both tie plates associated with each tie may be inserted simultaneously and, if the machine further comprises vertically adjustable centering tongs arranged between the two operating units, the tongs comprising two tong parts reciprocal in the direction of the longitudinal extension of the machine frame for engaging the longitudinal edges of the tie, an exact perpendicular alignment of the tie with respect to the rails may be effected before the tie plates are inserted.

In accordance with another preferred feature, the machine further comprises a carrier frame for the operating units and flanged wheels supporting the carrier frame and running on the rails in the range of the operating units, the carrier frame having an end spaced from the flanged wheels in the direction of the longitudinal extension of the machine frame and linked to the machine frame, and a vertical adjustment drive connected to the carrier frame. This arrangement will automatically center the operating unit with respect to the track center as the carrier frame is guided along the track rails by the flanged wheels.

The portion of the rail in the range of the rail base wherebelow the tie plates are inserted will be kept free of encumbrance by the rail lifting device if the same comprises rail lifting rollers pivotally mounted on the carrier frame adjacent the flanged wheels, and drive means is provided for pivoting the lifting rollers into subtending engagement with the rail heads.

According to another preferred feature, the machine further comprises a roller conveyor extending in the direction of the longitudinal extension of the machine frame and arranged to convey tie plates to the magazine. This makes it possible automatically to deliver a tie plate to the magazine after each tie plate inserting operation so that only a single tie plate is stored in the magazine at any one time, which avoids possible operating difficulties in removing a tie plate from a stack of tie plates by the transversely displaceable tie plate inserting arm.

If the machine further comprises an operator's cab arranged on the machine frame at an end of the roller conveyor opposite the magazine in the direction of the longitudinal extension of the machine frame, a sorting table at the roller conveyor end, and a conveyor band extending in the direction of the longitudinal extension of the machine frame and arranged to convey tie plates to the sorting table, an operator in the cab has the opportunity to place any tie plates delivered randomly by the conveyor band in the proper position on the roller conveyor so that the automatic insertion operation will proceed properly and without interruption.

Old tie plates previously removed from the ties being exchanged and placed on the track bed can be re-used in the operation of the machine if it further comprises a funnel arranged at an end of the conveyor band opposite the sorting table, a vertically adjustable and rotatable crane boom adjacent said conveyor band end, and a demagnetizable tie plate collecting magnet affixed to the crane boom and arranged to release tie plates collected by the magnet into the funnel upon demagnetization of the magnet. In this case, the machine preferably further comprises a self-propelled carriage supporting the crane boom on the machine frame for displacement in the direction of longitudinal extension of the machine frame along a predetermined displacement path, the machine frame defining a transversely centered opening along the displacement path for passage of the crane boom therethrough upon vertical adjustment thereof. This enables the crane boom to be lowered so that the magnet can pick up the old tie plates from the track bed, and then to be raised with the picked up tie plates to deliver them into the funnel upon demagnetization of the collecting magnet.

In a preferred embodiment of the invention, the tie plate inserting machine has a respective operating unit associated with each rail mounted on a carrier frame, and further comprises a respective roller conveyor extending in the direction of the longitudinal extension of the machine frame and arranged to convey tie plates to a respective one of the magazines, operator's cabs at an end of the roller conveyors opposite the magazines in the direction of the longitudinal extension of the machine frame, a sorting table at the roller conveyor end, and a drive connected to the carrier frame for displacement thereof in the direction of the longitudinal extension of the machine frame, the roller conveyors and the cab being longitudinally displaceable with the carrier frame. This enables the operating units to be centered exactly with respect to the tie after the machine has been stopped in the operating position. If operator's cabs are mounted on the machine frame for longitudinal displacement with respect to the machine frame, and the cabs are connected to the carrier frame by a coupling rod, the distance between the operator's cabs and the sorting table connected to the roller conveyor can be held constant.

BRIEF DESCRIPTION OF THE DRAWING

The above and other objects, advantages and features of the present invention will now be explained in detail in connection with a now preferred embodiment thereof, taken in conjunction with the accompanying, partly schematic drawing wherein

FIG. 3 is a fragmentary and enlarged view showing the operating unit in side elevation; and FIG. 4 is a fragmentary and enlarged top view of the operating unit.

DETAILED DESCRIPTION OF THE PREFERRED EMBODIMENT

Figure 1:
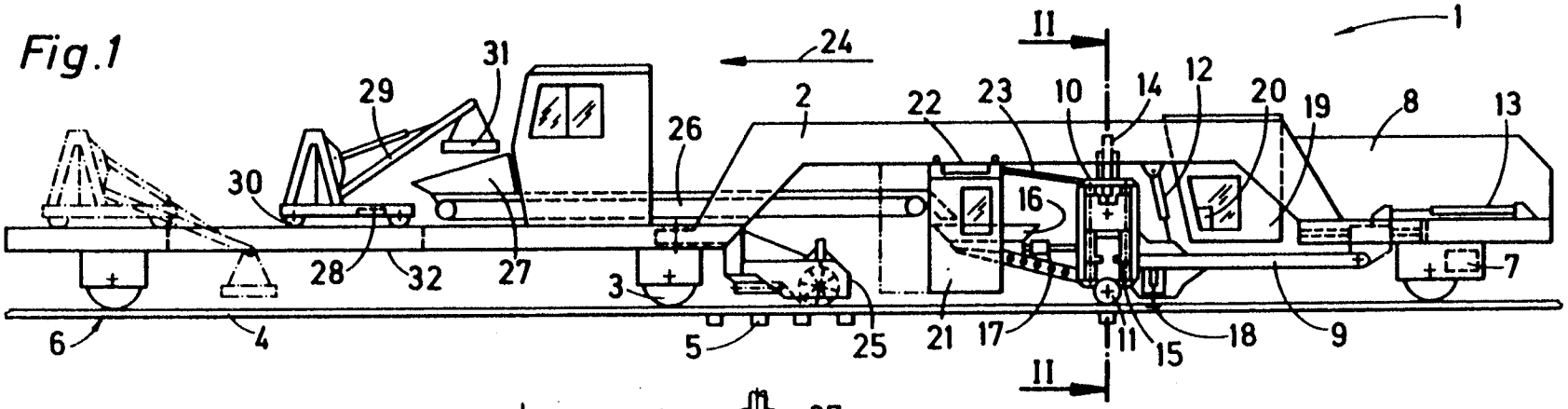
FIG. 1 is a side elevational view of a tie plate inserting machine according to this invention.

Referring now to the drawing, there is shown machine 1 for inserting tie plate 33 between tie 5 and rail 4 having a head and a base interconnected by a web. The illustrated machine comprises machine frame 2 supported on undercarriages 3 on railroad track 6 including two rails 4 resting on a multiplicity of ties 5. In the illustrated embodiment, machine frame 2 is comprised of two parts, which are linked together for ready movement of the elongated machine frame along track curves, and carries power plant 8 supplying energy to all operating drives of the machine, including drive 7 for propelling the machine frame along the track in an operating direction indicated by arrow 24.

Figure 2:
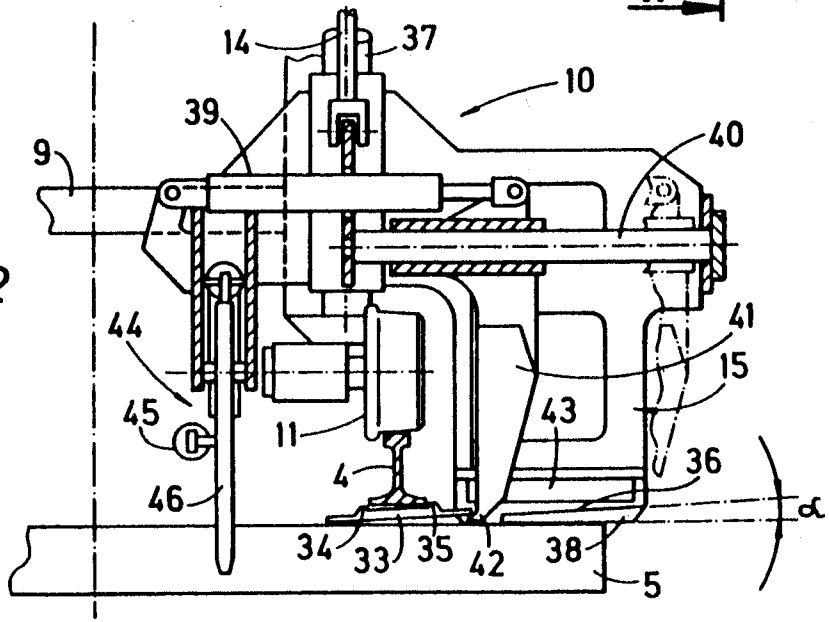
FIG. 2 shows a fragmentary and enlarged transverse cross section of the operating unit of the machine along line II—II of FIG. 1.

Operating unit 10 is mounted in an upwardly recessed portion of machine frame 2 on carrier frame 9 running on rails 4 on flanged wheels 11 in the range of operating unit 10°The carrier frame has an end spaced from the flanged wheels in the direction of the longitudinal extension of machine frame 2 and linked to the machine frame, and vertical adjustment drive 12 connects carrier frame 9 to machine frame 2 (see FIG. 1). The operating unit comprises vertically adjustable magazine 15 for storing at least one plate 33 and drive 14 for vertically adjusting the magazine along vertical guide bearings 37. As shown in FIG. 2, tie plate magazine 15 is arranged on the field side of rail 4 and includes tie plate support 36 at the bottom thereof, the tie plate support having a support surface extending in a transverse plane with respect to machine frame 2 and the transverse plane having a gradient $\alpha$ of about 3° to 10°. The tie plate support has one end facing the rail and another end opposite thereto, the one tie plate end being lower than the other tie plate end. The tie plate has two parallel ribs 34, 35 wherebetween the rail base is held, and this arrangement will enable leading rib 34 readily to slip into the gap between the tie and the rail base when tie plate 33 glides down inclined support 36 and is inserted by transversely displaced tie plate inserting arm 41.

Transverse guide rod 40 is affixed to the operating unit and glidably supports tie plate inserting arm 41 for moving a respective tie plate 33 stored in magazine 15 from the magazine to a position between tie 5 and the base of rail 4 (see FIG. 2), the tie plate inserting arm being transversely displaceable with respect to machine frame 2 along guide rod 40 which connects the tie plate inserting arm to operating unit 10, and drive 39 is connected to arm 41 for transversely displacing the tie plate inserting arm.

Rail lifting device 18 is associated with the operating unit. As best shown in FIG. 3, rail lifting device 18 comprises rail lifting rollers 47 pivotally mounted on carrier frame 9 adjacent flanged wheels 11, and drives 48 pivot the lifting rollers into subtending engagement with the rail heads.

The tie plate inserting arm has an end connected to finger-like extension 42 inclined in a direction towards the center of the machine frame, and tie plate support 36 defines slot 38 for receiving the tie plate inserting arm end, the slot extending in a direction parallel to the longitudinal extension of tie 5 and centrally with respect to the longitudinal extension of machine frame 2.

In the illustrated embodiment, a respective operating unit 10 is associated with each rail 4, and machine 1 further comprises vertically adjustable centering tongs 44 arranged between the two operating units, the tongs comprising two tong parts 46 reciprocal by drive 45 in the direction of the longitudinal extension of the machine frame for engaging the longitudinal edges of tie 5.

Tie plate magazine 15 is vertically adjustable by drive 14 and roller conveyor 17 is associated with each magazine and extends in the direction of the longitudinal extension of the machine frame. The roller conveyors are inclined to convey tie plates 33 sequentially and one by one from sorting table 16 at one end of the roller conveyor to magazine 15 at the opposite end thereof, the tie plate magazine defining slot 43 adjacent tie plate support 36 to enable tie plate 33 to be passed through the slot onto the support. To enable an operator to observe and control the operation of unit 10, cab 19 is mounted on machine frame 2 within sight of the operating unit and holds control panel 20 for actuating the various operating drives of the machine.

Operator's cabs 21 are mounted at an end of roller conveyors 17 opposite magazines 15 in the direction of the longitudinal extension of machine frame 2 and laterally adjacent sorting tables 16. The operator's cabs are glidably supported on machine frame 2 by guides 22 extending longitudinally with respect to the machine frame and are coupled to operating units 10 and carrier frame 9 by coupling rods 23. Drive 13 is connected to carrier frame 9 for displacement thereof in the direction of the longitudinal extension of machine frame 2, the roller conveyors and cabs 21 being longitudinally displaceable with the carrier frame.

As shown in FIG. 1, machine frame 2 of illustrated tie plate inserting machine 1 further carries vertically adjustable rotary broom 25 extending transversely across the track, substantially horizontally extending conveyor band 26 extending thereabove in a longitudinal direction with respect to the machine frame, and funnel 27 arranged at an end of the conveyor band opposite the sorting table 16. The leading machine frame part carries vertically adjustable and rotatable crane boom 29 adjacent this conveyor band end, and demagnetizable tie plate collecting magnet 31 is affixed to the crane boom and arranged to release tie plates collected by the magnet into the funnel upon demagnetization of the magnet. A self-propelled carriage running on the leading machine frame part on rollers 30 and propelled by drive 30 supports crane boom 29 on the machine frame for displacement in the direction of longitudinal extension of the machine frame along a predetermined displacement path, and the leading machine frame part defines transversely centered opening 3 along the displacement path for passage of the crane boom therethrough upon vertical adjustment thereof.

FIG. 3 clearly illustrates the centered arrangement of tie plate inserting arm 41 with respect to the associated tie plate magazine 15, the lower portion of arm 41 being positioned in slot 38 of tie plate support 36. Lifting roller 47 of rail lifting device 18 is transversely pivotal by drive 48 about axis 49 extending in the direction of longitudinal extension of machine frame 2 for subtending engagement with the head of rail 4. Roller conveyor 17 is comprised of a multiplicity of transversely extending rollers freely rotatable about transverse horizontal axes, and is displaceable in the longitudinal direction and pivotal about an axis extending perpendicularly thereto by drives 50, 51 whereby the spacing between the roller conveyor and the tie plate magazine as well as the inclination of the roller conveyor may be varied.

As illustrated in FIG. 4, the lower end of roller conveyor 17 abuts tie plate magazine 15 so that each tie plate may be readily transferred therefrom to support 36.

The operation of the illustrated tie plate inserting machine will now be described in detail:

After the exchange of worn ties by new ties in a preceding operation which includes heaping tie plates 33 removed from the old ties in the center of track 6 between rails 4, machine 1 is moved into position for inserting the tie plates between new ties 5 and the bases of rails 4. For this purpose, collecting magnet 31 is lowered by crane boom 29 through opening 32 in machine frame 2 to pick up the tie plates from the track bed and to lift them up until magnet 31 is in vertical alignment with funnel 27. The magnet is then demagnetized to release the picked up tie plates, which fall into the funnel and are conveyed by conveyor band 26 to sorting table 16 where tie plates 33 ar properly assorted by an operator in cab 21, who places them sequentially in a row on roller conveyor 17. Vertical adjustment drive 14 is actuated to level lateral slot 43 of tie plate magazine 15 with the lower end of the roller conveyor. In this position, abutment 52 (see FIG. 4) on the roller conveyor is pivoted out of the way to permit leading tie plate 33 on the roller conveyor to glide through slot 43 onto tie plate support 36 of magazine 15, whereupon abutment 52 is pivoted back into its retaining position to prevent the following tie plate from slipping off roller conveyor 17. Drive 14 is then actuated again to lower magazine 15 with tie plate 33 on support 36 into its lower end position illustrated in FIG. 2. At the same time, drive 48 is actuated to pivot lifting roller 47 into subtending engagement with the head of rail 4 and drive 12 is actuated to lift the rail until a gap of about 35 mm appears between the base of the rail and the upper surface of tie 5. Simultaneously, drive 45 is actuated to engage tong parts 46 of centering tongs 44 with tie 5 whereby the tie is oriented perpendicularly to the rails.

In this position, drive 39 is actuated to displace tie plate inserting arm 41 transversely in the direction of rail 4, causing finger-like projecting end 42 of the arm to subtend tie plate 33 which subsequently glides down the slope of tie plate support 36, which has a gradient $\alpha$ of about 3° to 10°, until it is placed between tie 5 and the base of rail 4. Since trailing rib 35 lies higher than leading rib 34 of tie plate 33, the trailing rib forms an abutment for the field end of the rail base and prevents further transverse displacement of the tie plate, holding it in the correct end position wherein the rail base rests between the tie plate ribs. Fluid pressure is now relieved in lifting drives 12 so that rail 4 comes to rest on the tie plate and the tie. At the same time, drive 39 is actuated again to retract tie plate inserting arm 41 into its rest position indicated in phantom lines in FIG. 2 and drive 14 is actuated to raise tie plate magazine 15 into its charging position for receiving a subsequent tie plate from the roller conveyor. After centering tongs 44 are disengaged from tie 5 and raised, drive 7 is actuated to propel machine 1 to the following newly inserted tie, where the above-described operation is repeated. If tie plat magazine 15 is not in exact vertical registry with this tie, longitudinal displacement drive 13 is actuated to move operating unit 10 into a centered position with respect to the tie. Ballast broom 25 is rotated while machine 1 moves in the operating direction indicated by arrow 24 so that the tie surfaces in the area of the tie plates is continuously cleaned, enabling tie plates 33 to be inserted without problems.

If desired, machine 1 may be operated with new tie plates, rather than re-used ones, in which case a storage bin holding new tie plates is carried on machine frame 2 and the tie plates are conveyed from the bin to roller conveyor 17 by conveyor band 26. Also, two or more operating units 10 may be arranged sequentially on the machine at the field sides of rails 4 so that tie plates may be placed simultaneously on two sequential ties. Furthermore, it would be possible to place more than one, for example, ten tie plates, in magazine 15, the stack of tie plates resting on support 36 and tie plate inserting arm 41 engaging the lowest tie plate of the stack for insertion between the tie and the rail base.

What is claimed is:

1. A machine for inserting a tie plate between a tie and a rail having a head and a base interconnected by a web, which comprises (a) a machine frame supported on undercarriages on a railroad track including two of said rails resting on a multiplicity of said ties, (b) a drive for propelling the machine frame along the track in an operating direction, (c) an operating unit mounted on the machine frame and comprising (1) a vertically adjustable magazine for storing at least one of said tie plates and (2) a drive for vertically adjusting the magazine, (d) a tie plate inserting arm for moving a respective one of the tie plates stored in the magazine from the magazine to a position between the tie and the base of the rail, the tie plate inserting arm being transversely displaceable with respect to the machine frame and being connected tot he operating unit, (e) a drive connected to the tie plate inserting arm for transversely displacing the tie plate inserting arm,, and (f) a rail lifting device arranged on the machine frame.

2. The tie plate inserting machine of claim 1, wherein the magazine includes a tie plate support, the tie plate support extending in a transverse plane with respect to the machine frame and the transverse plane having a gradient of about 3° to 10°, and the tie plate support having one end facing the rail and another end opposite thereto, the one tie plate end being lower than the other tie plate end.

3. The tie plate inserting machine of claim 2, wherein the tie plate inserting arm has an end connected to a finger like extension inclined in a direction towards the center of the machine frame, and the tie plate support defines a slot for receiving the tie plate inserting arm end, the slot extending in a direction parallel to the longitudinal extension of the tie and centrally with respect to the longitudinal extension of the machine frame.

4. The tie plate inserting machine of claim 1, wherein a respective one of the operating units is associated with each of the rails, and further comprising vertically adjustable centering tongs arranged between the two operating units, the tongs comprising two tong parts reciprocal in the direction of the longitudinal extension of the machine frame for engaging the longitudinal edges of the tie.

5. The tie plate inserting machine of claim 1, further comprising a carrier frame for the operating unit and flanged wheels on the carrier frame and running on the rails in the range of the operating unit, the carrier frame having an end spaced from the flanged wheels in the direction of the longitudinal extension of the machine frame and linked to the machine frame, and a vertical adjustment drive connected to the carrier frame.

6. The tie plate inserting machine of claim 5, wherein the rail lifting device comprises rail lifting rollers pivotally mounted on the carrier frame adjacent the flanged wheels, and drive means for pivoting the lifting rollers into subtending engagement with the rail heads.

7. The tie plate inserting machine of claim 6, wherein a respective one of the operating units is associated with each of the rails on the carrier frame, and further comprising a respective roller conveyor extending in the direction of the longitudinal extension of the machine frame and arranged to convey tie plates to a respective one of the magazines, an operator's cab at an end of the roller conveyor opposite the magazines in the direction of the longitudinal extension of the machine frame, a sorting table at the roller conveyor end, and a drive connected to the carrier frame for displacement thereof in the direction of the longitudinal extension of the machine frame, the roller conveyors and the cabs being longitudinally displaceable with the carrier frame.

8. The tie plate inserting machine of claim 7, wherein the operator's cab is mounted on the machine frame for longitudinal displacement with respect to the machine frame, and further comprising a coupling rod connecting the cab to the carrier frame.

9. The tie plate inserting machine of claim 1, further comprising a roller conveyor extending in the direction of the longitudinal extension of the machine frame and arranged to convey tie plates to the magazine.

10. The tie plate inserting machine of claim 9, further comprising an operator's cab arranged on the machine frame at an end of the roller conveyor opposite the magazine in the direction of the longitudinal extension of the machine frame, a sorting table at the roller conveyor end, and a conveyor band extending in the direction of the longitudinal extension of the machine frame and arranged to convey tie plates to the sorting table.

11. The tie plate inserting machine of claim 10, further comprising a funnel arranged at an end of the conveyor band opposite the sorting table, a vertically adjustable and rotatable crane boom adjacent said conveyor band end, and a demagnetizable tie plate collecting magnet affixed to the crane boom and arranged to release tie plates collected by the magnet into the funnel upon demagnetization of the magnet.

12. The tie plate sorting machine of claim 10, further comprising a self-propelled carriage supporting the crane boom on the machine frame for displacement in the direction of longitudinal extension of the machine frame along a predetermined displacement path, the machine frame defining a transversely centered opening along the displacement path for passage of the crane boom therethrough upon vertical adjustment thereof.

* * * * *